US008260187B2

(12) United States Patent
Honda et al.

(10) Patent No.: US 8,260,187 B2
(45) Date of Patent: Sep. 4, 2012

(54) IMAGE FORMING DEVICE

(75) Inventors: Haruyuki Honda, Tokyo (JP); Yasuo Matsuyama, Hyogo (JP); Hiroshi Fujiwara, Osaka (JP); Kazuyoshi Kondo, Osaka (JP); Yasuhide Ohkubo, Osaka (JP); Ippei Kimura, Osaka (JP); Toshikane Nishii, Osaka (JP); Mizuna Tanaka, Osaka (JP); Tomoyoshi Yamazaki, Tokyo (JP); Masafumi Takahira, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 987 days.

(21) Appl. No.: 12/289,187

(22) Filed: Oct. 22, 2008

(65) Prior Publication Data

US 2009/0110459 A1 Apr. 30, 2009

(30) Foreign Application Priority Data

Oct. 24, 2007 (JP) ..... 2007-276881

(51) Int. Cl.
*G03G 15/00* (2006.01)

(52) U.S. Cl. ..... 399/397; 399/107; 399/110

(58) Field of Classification Search ..... 399/397, 399/107, 110

See application file for complete search history.

(56) References Cited

U.S. PATENT DOCUMENTS

| | | | | |
|---|---|---|---|---|
| 5,937,262 | A * | 8/1999 | Cho | 399/401 |
| 6,308,952 | B1 * | 10/2001 | Takagi et al. | 271/297 |
| 6,473,579 | B1 * | 10/2002 | Suzuki et al. | 399/124 |
| 2003/0235449 | A1 * | 12/2003 | Ahn | 399/401 |
| 2004/0124575 | A1 * | 7/2004 | Lee et al. | 271/10.01 |
| 2005/0141921 | A1 * | 6/2005 | Baek | 399/167 |
| 2007/0065201 | A1 | 3/2007 | Fujiwara et al. | |
| 2008/0273908 | A1 | 11/2008 | Ohkubo et al. | |
| 2008/0284090 | A1 | 11/2008 | Honda et al. | |

FOREIGN PATENT DOCUMENTS

| | | | |
|---|---|---|---|
| JP | 07267424 | A * | 10/1995 |
| JP | 3176206 | | 4/2001 |
| JP | 2001199610 | A * | 7/2001 |
| JP | 2007-022766 | | 2/2007 |
| JP | 2007-131767 | | 5/2007 |
| WO | WO 2005082634 | A1 * | 9/2005 |

OTHER PUBLICATIONS

Machine translation of JP 2001199610 A, JPO, Nov. 24, 2011.*
Abstract for JP 7-206188 (Aug. 8, 1995).

* cited by examiner

*Primary Examiner* — Judy Nguyen
*Assistant Examiner* — Nguyen Q Ha
(74) *Attorney, Agent, or Firm* — Harness, Dickey & Pierce, P.L.C.

(57) ABSTRACT

An image forming device is disclosed. The device includes a toner-image forming unit which forms a toner image; a transfer unit; a fixing unit; a paper-output unit; a drive unit; a first drive-power transmission gear; a second drive-power transmission gear; a gear housing; a first positioning unit which positions the fixing unit relative to a device body; and a second positioning unit. The second positioning unit positions the paper-output unit relative to the device body in the direction of a gap between the first drive-power transmission gear and the second drive-power transmission gear by engaging the gear housing with the device body.

8 Claims, 14 Drawing Sheets

IMAGE FORMING DEVICE

TECHNICAL FIELD

The present invention relates to an image forming device such as a copier, a fax machine, or a printer.

BACKGROUND ART

An image forming device, as disclosed in JP2007-022766A, for example, transfers, onto a transfer paper, a toner image formed on a photosensitive body surface, and fixes, with a fixing roller pair of a fixing apparatus, the toner image transferred onto the transfer paper. Then, the transfer paper with the toner image fixed is conveyed from the fixing apparatus to a paper-output path, and output onto a paper-output tray outside the image forming device by means of a paper output apparatus having a paper-output roller pair.

In general, a paper output apparatus used in an image forming device as disclosed in JP2007-022766A is provided with, as a driving source, a dedicated motor which rotationally drives a paper-output roller. Presently, efforts are being put into reducing the size and cost of image forming devices. If it is made possible to share a drive source of the paper-output roller with drive sources of other apparatuses, it is anticipated that the likelihood of reducing the size and cost of the image forming devices would increase.

The image forming device as recited in JP2007-131767 (referred to below as a related-art application) by the present inventors has a fixing apparatus and a paper output apparatus sharing a drive source. The image forming device as recited in the related-art application has a fixing-side transmission gear which transfers, from the fixing apparatus side to the paper-output apparatus side, the drive power from the drive source that drives a fixing roller. Moreover, a gear housing, which rotatably supports each of a paper-output side transmission gear which engages its fixing side transmission gear and receives the drive power, and multiple drive-power transmission gears which transmit the drive power from the paper-output side transmission gear to a paper-output gear provided on the same axis as a paper output roller, is mounted on a side wall of a paper output apparatus in the direction of the paper-output roller axis. Then, the device is arranged to transmit the drive power transmitted from the fixing-side transmission gear to the paper-output side transmission gear to the paper-output gear via the multiple drive-power transmission gears of the gear housing, and drive the paper output roller. In this way, the transmission of the drive power from the fixing apparatus to the paper output apparatus via the multiple gears of the gear housing allows sharing of the drive source between the fixing apparatus and the paper output apparatus, thus making possible a reduced size and cost of the image forming device without the need for providing a dedicated drive source for driving the paper output roller.

However, when the image forming device as recited in the above related-art application was manufactured, the engaging of the fixing-side transmission gear with the paper-output side transmission gear was found to be insufficient, causing the drive power transmitted to the paper-output side transmission gear to be unstable. Thus, when the engaging of the fixing-side transmission gear with the paper-output side transmission gear becomes insufficient, the drive power cannot be transmitted smoothly from the fixing-apparatus to the paper output apparatus via the gears. The fixing-side transmission gear and the paper-output side transmission gear not engaging appropriately may be caused by tolerances in the direction of the gap between the fixing-side transmission gear and the paper-output side transmission gear. The tolerances as described above result from a stack-up of such tolerances as component dimension tolerances and tolerances related to assembly. Then, such tolerances stacking up causes the intercentral distance between the fixing-side transmission gear and the paper-output side transmission gear to be larger or smaller than a predetermined distance, thus causing the fixing-side transmission gear and the paper-output side transmission gear to not engage properly. Therefore, there is also a potential for the fixing-side transmission gear and the paper-output side transmission gear to engage excessively rather than insufficiently as described above. Such excessive engaging of the fixing-side transmission gear and the paper-output side transmission gear causes the gears to become chipped or the rotating gear to lock.

Here, the "predetermined distance" as described above is the intercentral distance when the fixing-side transmission gear and the paper-output side transmission gear are engaged such that the drive power is smoothly transmitted from the fixing-side transmission gear and the paper-output side transmission gear.

In order to reduce the component dimension tolerances, and the tolerances related to assembly as described above, it is possible to use a high-precision processed component, or to spend more time in assembly to achieve high precision. However, using a high-precision processed component or spending more time in assembly to achieve high precision causes the cost of manufacturing the image forming device to increase.

DISCLOSURE OF THE INVENTION

Accordingly, it is a general object of the present invention to provide an image forming device that makes it possible to appropriately engage, at low cost, a first drive-power transmission gear provided at a fixing unit and a second drive-power transmission gear provided at a gear housing, and to smoothly transmit the drive power between the fixing unit and the paper-output unit.

According to an embodiment of the present invention, an image forming device is provided, including: a toner-image forming unit which forms a toner image; a transfer unit which transfers, to a transfer material, the toner image formed by the toner-image forming unit; a fixing unit which fixes, to the transfer material by a pair of fixing rollers, the toner image transferred by the transfer unit; a paper-output unit which outputs, out of the device by a pair of paper-output rollers, the transfer material to which the toner image is fixed by the fixing unit; a drive unit which drives the pair of fixing rollers or the pair of paper-output rollers; a first drive-power transmission gear, provided at the fixing unit, for transmitting from a fixing-unit side to a paper-output unit side drive power by the drive unit, or receiving drive power transmitted from the paper-output unit side to the fixing-unit side; a second drive-power transmission gear, engaged with the first drive-power transmission gear, for having drive power transmitted from the first drive-power transmission gear or transmitting drive power to the first drive-power transmission gear; a gear housing, mounted on a side wall of the paper-output unit in an axial direction of the paper-output rollers, for rotatably supporting the second drive-power transmission gear, and multiple drive-power transmission gears which transmit drive power between the second drive-power transmission gear and the paper-output rollers; a first positioning unit which positions the fixing unit relative to a device body; and a second positioning unit which positions the paper-output unit relative to the device body, wherein the second positioning unit positions the paper-output unit relative to the device body in the direction of a gap between the first drive-power transmission gear and the second drive-power transmission gear by engaging the gear housing with the device body.

Now, when the present inventors analyzed the image forming device as recited in the related-art application as described above, the tolerances in the direction of the gap between the paper-output side transmission gear supported by the gear housing and the fixing-side transmission gear provided at the fixing apparatus were found to result from a stack-up of such tolerances as the dimensional tolerance of the elements constituting the gear housing, the tolerance related to the assembly of the gear housing to the side wall of the paper-output apparatus (the assembly tolerance in the direction of the gap between the gear housing and the fixing apparatus), and the assembly tolerance in the direction of the gap between the fixing apparatus and the paper-output apparatus. In the image forming device recited in the related-art application as described above, each of the fixing apparatus and the paper-output apparatus is positioned relative to and assembled in the device body. Thus, the effect of the assembly tolerance in the direction of the gap between the fixing apparatus and the paper-output apparatus on the tolerance in the direction of the gap between the fixing apparatus and the paper-output apparatus is eliminated. However, even when the effect of the assembly tolerance as described above is eliminated, the stacking up of the other tolerances as described above was found to possibly cause the positional relationship in the direction of the gap between the paper-output side transmission gear and the fixing-side transmission gear to be displaced.

In the embodiment of the present invention, the paper-output unit is arranged to engage the gear housing and the device body when assembling it into the device body so as to position it relative to the device body in the direction of the gap between the first drive-power transmission gear and the second drive-power transmission gear. In this way, the effect of the assembly tolerance related to the assembly of the gear housing to the side wall of the paper-output unit on the tolerance in the direction of the gap between the first drive-power transmission gear and the second drive-power transmission gear is eliminated. Thus, the decrease in the tolerance in the gap direction by the above-described eliminated tolerance makes it easier for the first drive-power transmission gear and the second drive-power transmission gear to properly engage. Thus, it is made easier to smoothly transmit the drive power between the first drive-power transmission gear and the second drive-power transmission gear.

Accordingly, the present invention has an excellent advantage of making it possible to properly engage, at low cost, a first drive-power transmission gear provided at a fixing unit and a second drive-power transmission gear provided at a gear housing, and to smoothly transmit the drive power between the fixing unit and the paper-output unit.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Descriptions are given next, with reference to the accompanying drawings, of embodiments of the present invention.

The present invention is not limited to the specifically disclosed embodiments, but variations and modifications may be made without departing from the scope of the present invention.

Embodiments according to the present invention are described, referring to FIG. 1 through FIG. 18.

Below, an embodiment of an electrophotographic printer (below called simply a printer) as an image forming device to which the present invention is applied is described.

Figure 2:
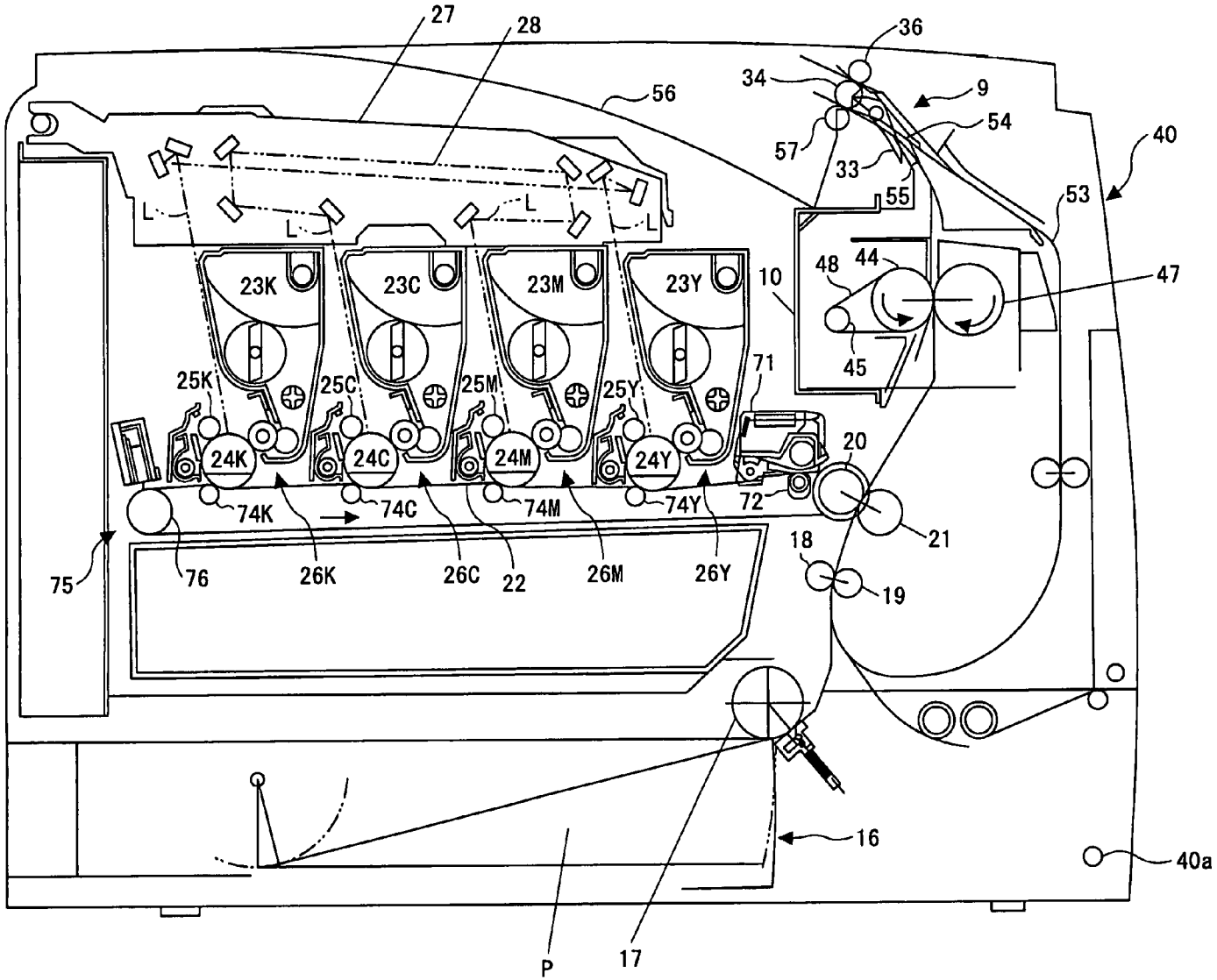
FIG. 2 is a schematic configuration diagram of a printer according to the present embodiments.
Figure 3:
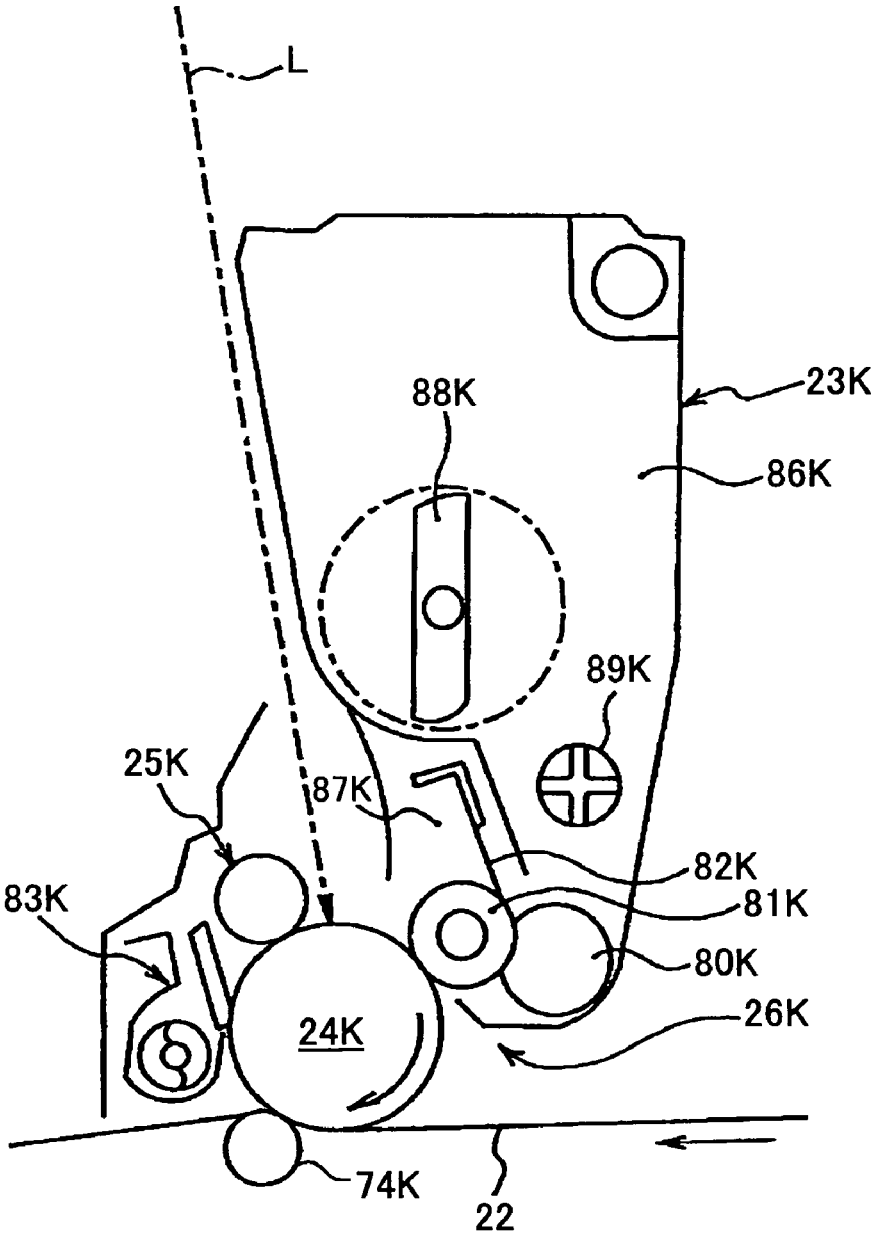
FIG. 3 is a schematic configuration diagram of a process unit.

First, the basic configuration of the present printer is described. FIG. 2 is a schematic configuration diagram showing the present printer. In the diagram, this printer includes four process units 26Y, 26M, 26C and 26K for forming yellow, magenta, cyan and black (below shown as Y, M, C and K) toner images, respectively. These units use toners of mutually different colors of Y, M, C and K as imaging forming materials. Otherwise, they are configured similarly, and are replaced when their useful service life ends. For example, as shown in FIG. 3, a process unit 26K for forming a K toner image includes a drum-shaped photosensitive body 24K, which is a latent-image bearing body, a drum-cleaning apparatus 83, a neutralizing apparatus (not shown), an electrifying apparatus 25K and a developing apparatus 23K, etc,. The process unit 26K, which is an image forming unit, is detachable from the printer body, making it possible to replace consumable parts at once.

The electrifying apparatus 25K uniformly charges the surface of the photosensitive body 24K, which is rotated clockwise as shown, by a drive unit (not shown). The surface of the photosensitive body 24K that is uniformly charged is exposed by scanning with a laser beam L to bear an electrostatic latent image K. The electrostatic latent image K is developed into a K toner image by the developer apparatus 25K, which uses a K toner (not shown). Then, the K toner image is intermediate transferred onto a below-described intermediate transfer belt 22. The drum-cleaning apparatus 83K removes untransferred toner, which is attached to the surface of the photosensitive body 24K after undergoing the intermediate transfer process. Moreover, the neutralizing apparatus neutralizes the residual charges of the photosensitive body 24K after cleaning. This neutralizing initializes the surface of the photosensitive body 24K to prepare for forming the next image. In other color process units (26Y, 26M, 26C), the (Y, M and C) toner images are similarly formed on the photosensitive bodies (24Y, 24M, 24C) to be intermediate transferred onto the below-described intermediate transfer belt 22. An organic photoconductive layer is coated on the front face of a hollow aluminum base pipe to form a cylindrically-shaped drum section in the photosensitive body 24K. Flanges, each having a drum axis, are attached at both end sections in the axial line direction of the drum section to form the photosensitive body 24K.

The developing apparatus 23K, which is a unit for developing, has an oblong hopper section 86K, which houses K toner (not shown), and a developing section 87K. Within the hopper section 86K, an agitator 88K, which is rotationally driven by a drive unit (not shown), an agitating paddle 89K, which is rotationally driven in the vertically downward direction by the drive unit (not shown), and a toner-supplying roller 80K, which is rotationally driven in the vertical direction by the drive unit (not shown), etc., are arranged. The K toner within the oblong hopper section 86K moves toward the toner-supplying roller 80K by self weight, while being agitated by the rotational drive of the agitator 88K and the agitating paddle 89K. The toner-supplying roller 80K, which has a metallic cored bar, and a roller section including a foam resin coated on the surface thereof, rotates while attaching the K toner within the hopper section 86K to the surface of the roller section.

Within the developing section 87K of the developing apparatus 23K, a developing roller 81K, which rotates and at the same time abuts the photosensitive body 24K and the toner-supplying roller 80K, and a thin-layered blade 82K, which abuts with its tip the surface of the developing roller 81K, are arranged. The K toner attached to the toner-supplying roller 80K within the hopper section 86K is supplied onto the surface of the developing roller 81K at a section where the developing roller 81K abuts the toner-supplying roller 80K. The supplied K toner is regulated in the layer thickness on the developing roller 81K surface when passing, with the rotation of the developing roller 81K, the position where the developing roller 81K abuts the thin-layered blade 82K. Then, the layer-thickness regulated K toner is attached to the electrostatic latent image K on the photosensitive body 24K in a developing area which is a section where the K toner abuts the developing roller 81K and the photosensitive body 24K. Such attaching as described above develops the electrostatic latent image K into the K toner image.

While the process unit for K (26K) has been described using FIG. 3, Y, M and C toner images are formed on photosensitive body 2Y, 2M and 2C surfaces also in the process units for Y, M, and C (26Y, 26M, and 26C).

In FIG. 2, an optical writing unit 27 is arranged in the vertically upward direction of the process units 26Y, 26M, 26C, and 26K. The optical writing unit 27, which is an apparatus for latent-image writing, optically scans the photosensitive bodies 24Y, 24M, 24C, and 24K in the process units 26Y, 26M, 26C, and 26K. The optical scanning forms the electrostatic latent images Y, M, C, and K on the photosensitive bodies 24Y, 24M, 24C, and 24K. In such a configuration as described above, the optical writing unit 27 and the process units 26Y, 26M, 26C, 26K function as image forming units for forming Y, M, C, K toner images, which are visible images of corresponding different colors, onto three or more latent-image bearing bodies.

The optical writing unit 27 irradiates onto the photosensitive body, via multiple optical lenses and mirrors, the laser beam (L) originating from a beam source while polarizing it in the main scan direction with a polygon mirror rotationally driven by a polygon motor (not shown). A unit which optically writes with an LED beam originating from multiple LEDs of an LED array may be adopted.

A transfer unit 75 is provided, which endlessly moves the endless-shaped intermediate transfer belt 22 in the counterclockwise direction as shown while stretching the belt. The transfer unit 75, which is a unit for transferring, includes not only the intermediate transfer belt 22, but also a drive roller 76, a follower roller 20, four primary transfer rollers 74Y, 74M, 74C, 74K, a secondary transfer roller 21, a belt cleaning apparatus 71, and a cleaning backup roller 72.

The intermediate transfer belt 22 is stretched by the drive roller 76, the follower roller 20, the cleaning backup roller 72, and the four primary transfer rollers 74Y, 74M, 74C, 74K, which are arranged within a loop of the transfer belt 22. Then, the belt 22 is endlessly moved in the counterclockwise direction as shown by the torque of the drive roller 76, which is rotationally driven in the same direction by a drive unit (not shown).

The thus endlessly moved intermediate transfer belt 22 is sandwiched between the four primary transfer rollers 74Y, 74M, 74C, 74K and the photosensitive bodies 24Y, 24M, 24C, 24K. Such sandwiching as described above forms primary transfer nips for Y, M, C, K, where the front face of the intermediate transfer belt 22 and the photosensitive bodies 24Y, 24M, 24C, 24K abut.

Primary transfer biases are applied to the primary transfer rollers 74Y, 74M, 74C, 74K by a transfer bias power supply (not shown), thereby forming a transfer electric field between the electrostatic latent images of the photosensitive bodies 24Y, 24M, 24C, 24K, and the primary transfer rollers 74Y, 74M, 74C, 74K. Transfer chargers, transfer brushes, etc., may be adopted in lieu of the primary transfer rollers 74Y, 74M, 74C, 74K.

Y toner formed on the surface of the photosensitive body 24Y of the process unit 26Y is primary transferred onto the intermediate transfer belt 22 due to the effect of the transfer electric field and the nip pressure when entering the above-described primary transfer nip Y with the rotating of the photosensitive body 24Y. In this way, M, C, K toner images on the photosensitive bodies 24M, 24C, 24K are primary transferred and superposed over the Y toner image in successive overlays when the intermediate transfer belt 22 with the Y toner image thus primary transferred there passes through the primary transfer nips M, C, K with its endless movement. Such primary transferring with successive overlays as described above forms a four-color toner image on the intermediate transfer belt 22.

The intermediate transfer belt 22 is sandwiched between the follower roller 20 inside the loop, and the secondary transfer roller 21 of the transfer unit 75, which is arranged outside the loop of the intermediate transfer belt 22. Such sandwiching as described above forms a secondary transfer nip where the front face of the intermediate transfer belt 22 and the secondary transfer roller 21 abut. Secondary transfer bias is applied to the secondary transfer roller 21 with a transfer bias power supply (not shown). Such applying as described above forms a secondary transfer electric field between the secondary transfer roller 21, and the follower roller 20, which is connected to ground.

In the vertically downward direction of the transfer unit 75, a paper-supplying cassette 16, which houses multiple sheets of recording paper P overlaid in bundles, is arranged in a manner which is slidably detachable from the printer enclosure. The paper-supplying cassette 16, which has a paper-supplying roller 17 abutting a topmost sheet of the recording paper P on the paper bundle, rotates the roller 17 at a predetermined timing in the counterclockwise direction to send out the sheet of paper P onto a paper-supplying path.

Around the tail end of the paper-supplying path, a pair of resist rollers consisting of resist rollers 18 and 19 is arranged. Soon after the resist roller pair sandwiches in between the rollers 18 and 19 a sheet of recording paper P that is sent out from the paper supplying cassette 16, the rotation of the rollers 18 and 19 is stopped. Then, the rotational drive is resumed at a timing allowing the sandwiched recording paper sheet P to be synchronized with the four-color toner image on the intermediate transfer belt 22 in the above-described secondary transfer nip to send out the recording paper sheet P toward the secondary transfer nip.

The superposed four-color toner image on the intermediate transfer belt 22 thus abutting the recording paper sheet P in the secondary transfer nip is collectively secondary transferred onto the recording paper sheet P due to the effect of the secondary transfer electric field and the nip pressure, and, together with the white color of the recording paper sheet P, forms a full-color toner image. The recording paper sheet P with the full-color toner image thus formed on its surface self-strips from the second transfer roller 21 and the intermediate transfer belt 22 upon passing the secondary transfer nip. Then, the paper sheet P is sent into a fixing apparatus 10 via a post-transfer conveying path.

Untransferred toner which has not been transferred to the recording paper sheet P is attached on the intermediate transfer belt 22 after passing the secondary transfer nip. The untransferred toner is cleaned from the belt 22 surface with the belt-cleaning apparatus 71, which abuts the front face of the intermediate transfer belt 22. The cleaning backup roller 72, arranged inside the loop of the intermediate transfer belt 22 backs up, from inside the loop, the belt cleaning with the belt-cleaning apparatus 71.

The fixing apparatus 10 is provided with a fixing roller 44, which stretches a fixing belt 48, a heating roller 45 which envelopes a heating source such as a halogen lamp (not shown), and a pressurizing roller 47, which rotates while abutting, at a predetermined pressure, the fixing roller 44 via the fixing belt 48. The recording paper sheet P sent into the fixing apparatus 10 is nipped into the fixing nip such as that the unfixed toner image bearing face adheres to the fixing belt 48. Then, the heat and pressure cause the toner within the toner image to soften so as to fix the full-color image.

When a single-side print mode is set by an operation of inputting into an operating section including a numeric-key section (not shown), and a control signal sent from a PC (not shown), the recording paper sheets P output from the fixing apparatus 10 are output from the device as they are. Then, the paper sheets are stacked at a stack section which is at a top face of a top cover 56 of the enclosure.

As shown in FIG. 2, a turnover unit 40, which is at the right edge of the present printer, can be opened and closed relative to the enclosure body by pivoting around a pivot axis 40*a*. When the printer is set in the double-face print mode, the recording paper sheet P, on one face of which is formed an image, is not output, but enters into a conveying path before the turnover of the turnover unit 40 with the reverse rotating of the conveying roller of a paper output apparatus 9, and is conveyed from top to bottom in the vertical direction. Then, the paper sheet P enters into a semi-circularly curved turnover conveying path after passing between rollers of a turnover conveying roller pair 77. Then, while its top and bottom faces are turned over as it is conveyed along the curvature shape, the advancing direction from top to bottom in the vertical direction also turns over so that it is conveyed from bottom to top in the vertical direction. Thereafter, it reenters the secondary transfer nip via the above-mentioned paper-supplying path. Then, after the other face of the paper sheet P has full-color image collectively secondary transferred, it is output from the device after successively passing through the post-transfer conveying path, the fixing apparatus 10, the post-fixing conveying path, the paper-output path, and the paper output apparatus 9.

In FIG. 2, the paper output apparatus 9 is arranged to have multiple paper-output rollers 34, 36, 57, and multiple rollers and gears (not shown), a branch guide 33 for selectively apportioning, at the upstream of the paper-output roller 34, transfer paper sheets P to either one of a paper-output conveying path 55, a switchback conveying path 53, and a double-face print conveying path 54. Moreover, three axes (not shown) of the paper-output rollers 34, 36, 57 are arranged in a substantially perpendicular manner with respect to the conveying direction, and are mutually arranged in a substantially parallel manner in the top-bottom direction.

The paper-output conveying path 55 is communicatively connected from the fixing apparatus 10 to a nip section which is formed with the paper-output roller 34 and the paper-output roller 57, while the switchback conveying path 53 is communicatively connected from the fixing apparatus 10 to a nip section which is formed with the paper-output roller 34 and the paper-output roller 36. Then, the double-face print conveying path 54 is communicatively connected from the nip section which is formed with the paper-output rollers 34 and 36 to resist rollers 18, 19 via the conveying rollers 77.

Moreover, the branch guide 33, for example, switches between conveying paths such that, at the time of the single-face printing, a transfer paper sheet P fixed with the fixing apparatus 10 is guided to the paper-output conveying path 55: at the time of the double-face printing, the single-face printed transfer paper sheet P is guided to the switchback conveying path 53; and at the time of the double-face printing, a transfer paper sheet P which has its trailing edge nipped by the nip section, which nip section is formed with the paper-output rollers 34 and 36 (the single-face printed transfer paper sheet) is guided to the double-face print conveying path 54.

Figure 4:
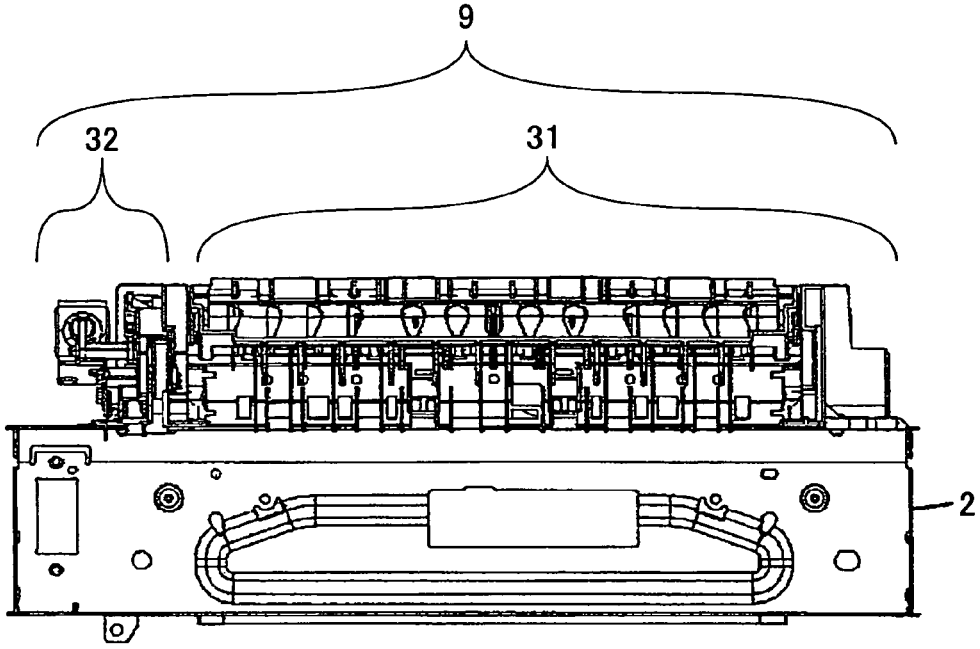
FIG. 4 is a front view of a paper output apparatus.

Next, the paper-output apparatus 9 is described. The paper-output apparatus 9, as shown in FIG. 4, which is arranged to include a paper conveying section 31 and a paper-output drive section 32, has a gear housing 11 of the paper-output drive section 32 fixed, with a screw, to a side face of a paper-output guide 12 to integrate the paper conveying section 31 and the paper-output drive section 32.

Figure 5:
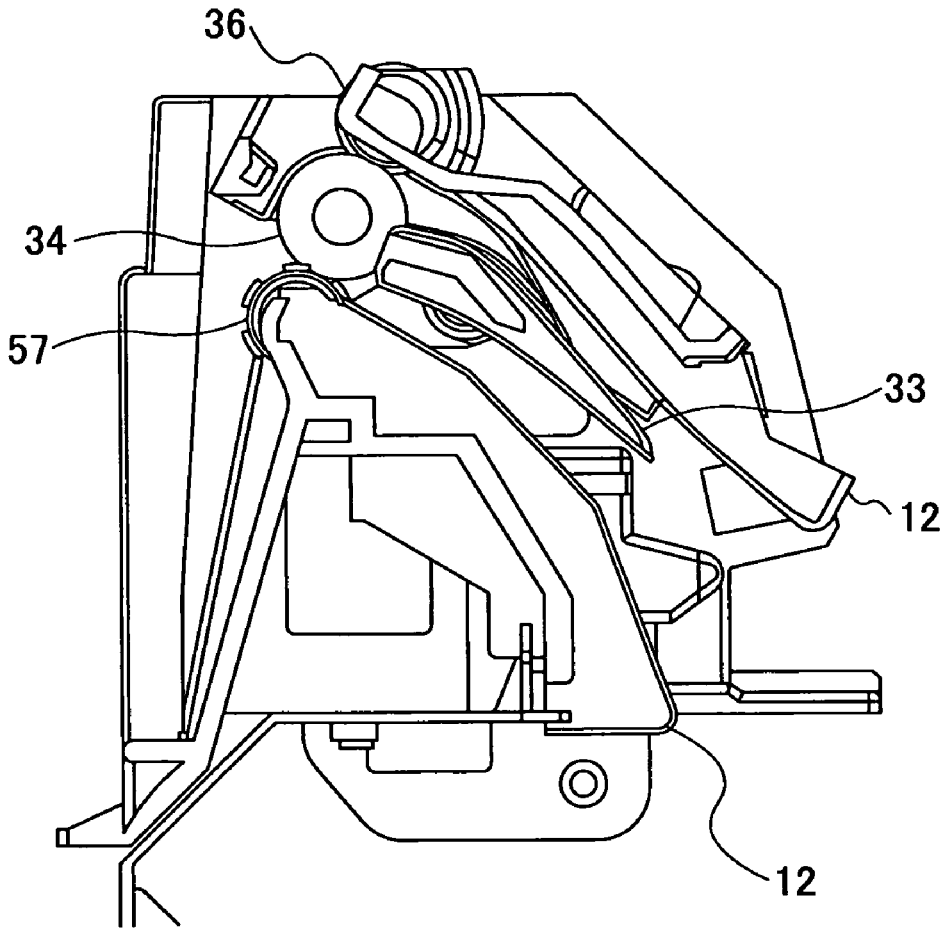
FIG. 5 is a side view of a paper output apparatus.

As shown in FIG. 5, the paper-conveying section 31 is arranged to include the output-paper guide 12, a branch guide 33, a paper-output roller 34, a paper-output roller gear 35, which is fixed to the edge of the paper-output roller 34, and two pairs of the paper-output rollers 36, 57.

Figure 6A:
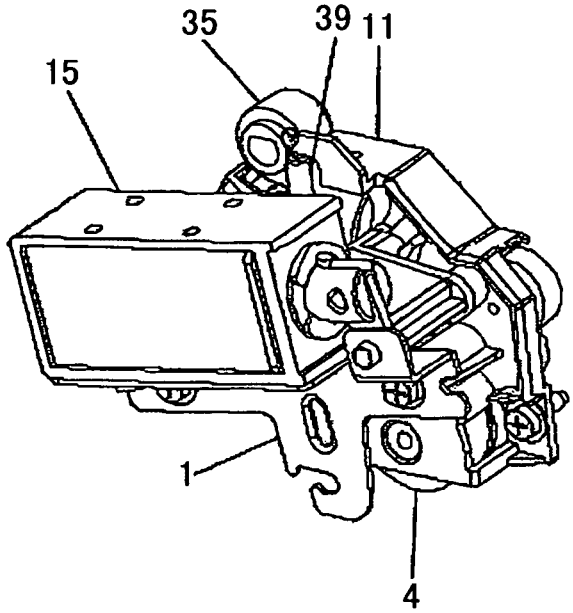
FIG. 6A is a perspective view of a paper output driver.
Figure 6B:
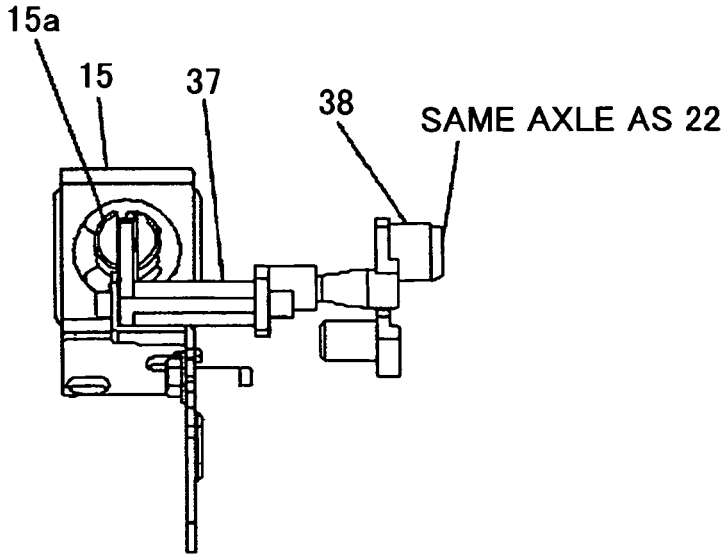
FIG. 6B is a front view of a paper output driver.

As shown in FIGS. 6A and 6B, the paper-output driver 32 is arranged to include the gear housing 11, which has embedded groups of gears including multiple drive-power transmission gears including a paper-output side delivery gear 4, a solenoid 15, a solenoid-fixing member 1, links 37 and 38, which transmit an operation of the solenoid 15 to the branch guide 33, and a return spring 39.

The solenoid 15 is screw-fixed to the solenoid-fixing member 1, which is then screw-fixed to the gear housing 11.

One edge of an arm portion of the link 37 is slidably fixed to an iron-core section 15*a* of the solenoid 15, while the other edge is slidably fixed to the link 38. Moreover, the link 37 is rotatably fixed between the solenoid-fixing member 1 and the gear housing 11.

The link 38, which is rotatably fixed between the gear housing 11 and the paper-output guide 12, has the branch guide 33 fixed to its rotational center, which branch guide 33 rotates and oscillates together with the link 38.

The return spring 39 has one edge attached to a hook-shaped section of the gear housing 11, and the other edge thereof attached to a hook-shaped section (not shown) of the link 37.

Figure 7:
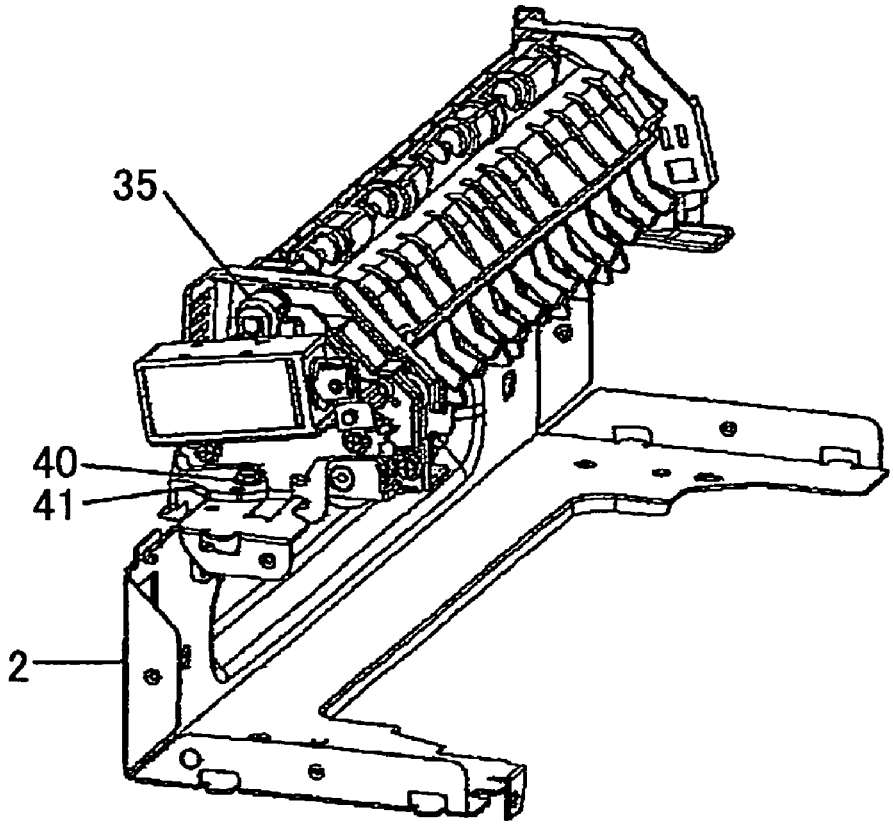
FIG. 7 is a perspective view of a paper output apparatus.

Moreover, the paper-output apparatus 9 is fixed to the printer body by collar sections 41 at both edges of the paper-output guide 12, as shown in FIG. 7. A body frame 2 has both edges supported with a pair of body side plates (not shown).

Figure 8:
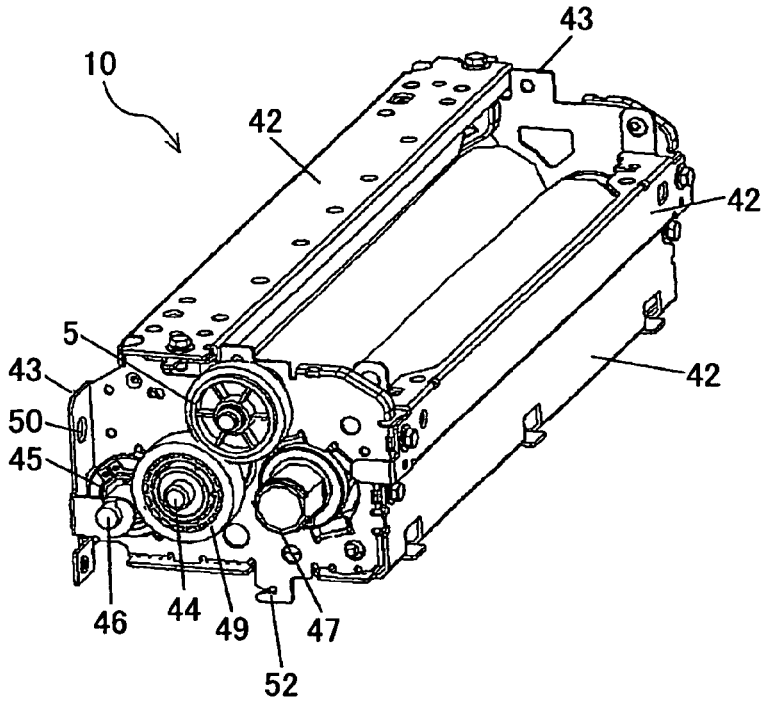
FIG. 8 is a perspective view of a fixing apparatus.

Next, the fixing apparatus 10 is described. As shown in FIG. 8, the fixing roller 44, the heating roller 45, and the pressurizing roller 47 are rotatably fixed within a fixing frame which is arranged to include a fixing frame stay 42, and a pair of fixing frame side plates 43.

Figure 9:
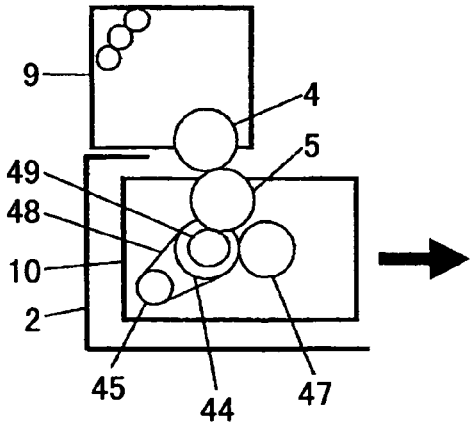
FIG. 9 is a schematic diagram illustrating the paper output apparatus and the fixing apparatus assembled to a device body.

As shown in FIG. 9, a fixing belt 48, which envelopes the fixing roller 44 and the heating roller 45, is tensioned with a belt-tension mechanism (not shown) such that the fixing belt 48 always touches the fixing roller 44 and the heating roller 45.

A heater lamp 46, which is provided within the heating roller 45, as shown in FIG. 8, is supplied electric power from a power supply section (not shown) to emit light and heat the heating roller 45. Heat generated from the thus-heated heating roller 45 is transferred to the fixing belt 48 by heat conduction to heat the fixing belt 48.

The pressurizing roller 47 is driven and rotates while applying pressure to the fixing roller 44 via the fixing belt 48 by means of a pressurizing mechanism (not shown).

As shown in FIG. 8, a fixing gear 49 is provided at the end of the axle of the fixing roller 44. Drive power is transmitted to the fixing gear 49 from a drive source (not shown) via multiple groups of idler gears. In this way, the fixing roller 44 is rotationally driven to fix toner images onto a paper sheet P conveyed between the fixing roller 44 and the pressurizing roller 47 via the fixing belt 48 with heat and pressure and, at the same time, convey the paper sheet P.

Moreover, a fixing-side delivery gear 5 is provided at the downstream side of the fixing gear 49, via which the drive power from the drive source is transmitted. The fixing-side delivery gear 5 engages the paper-output side delivery gear 4 of the paper-output apparatus 9 to transmit the drive power transmitted to the fixing-side delivery gear 5 to the paper-output side delivery gear 4.

Figure 10:
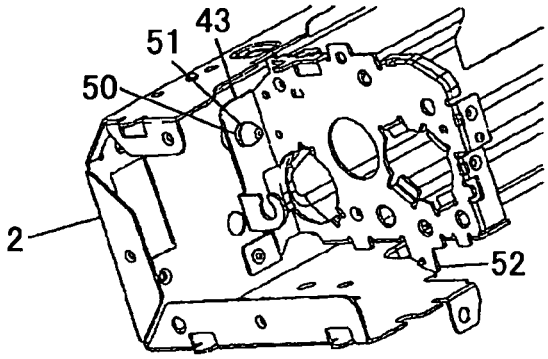
FIG. 10 is a perspective view illustrating the fixing apparatus positioned relative to and assembled to the device body.

The fixing apparatus 10 is fixed to the printer body by inserting a positioning pin 51, which is provided on the body frame 2, into a hole 50 of a bending section of a fixing-side plate 43 as shown in FIG. 10, inserting the body frame 2 into a chip section 52 of a fixing-frame side plate 43, and using a stopper mechanism (not shown) for ensuring that the fixing apparatus 10 does not come out in the direction as shown in FIG. 9.

Figure 11:
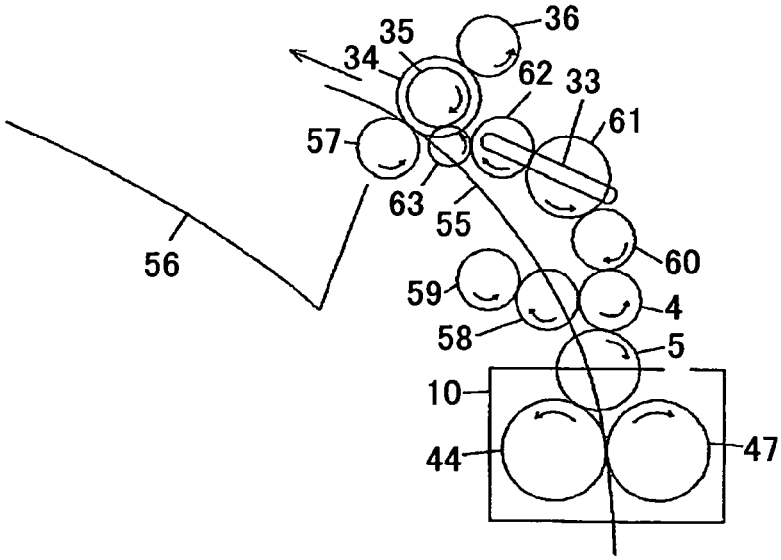
FIG. 11 is a schematic view illustrating a paper output operation in a single-face printing mode of the paper output apparatus.

Next, the paper-output operation of the paper output apparatus 9 at the time of the single-face printing is described using FIG. 11. In FIG. 11, the paper output apparatus 9 is arranged to include the paper-output side delivery gear 4, which engages the fixing-side delivery gear 5, which engages the fixing gear 49 (not shown in FIG. 11), provided at an axle of the paper-output roller 34 of the fixing apparatus 10, so that the fixing-side delivery gear 5 rotates in one direction (the clockwise direction as shown), and the paper-output side delivery gear 4 rotates in the counterclockwise direction; a transmission gear 58, which engages the paper-output side delivery gear 4 to rotate in the clockwise direction; a transmission gear 59, which engages the transmission gear 58 to rotate in the counterclockwise direction; a transmission gear 60, which engages the paper-output side delivery gear 4 to rotate in the clockwise direction; an oscillating gear 61, which engages the transmission gear 59 or 60 to rotate in the counterclockwise or clockwise direction; a transmission gear 62, which engages the oscillating gear 61 to rotate in the clockwise or counterclockwise direction; a transmission gear 63, which engages the transmission gear 62 to rotate in the counterclockwise or clockwise direction; a transmission gear 35, which is provided on the same axle as the paper-output roller 34 and engages the transmission gear 63 to rotate in the clockwise or counterclockwise direction; and a branch guide 33, which is provided at the oscillating gear 61 to oscillate.

The branch guide 33, onto which the oscillating gear 61 and the transmission gear 62 are mounted via the link 38, is arranged to oscillate and rotate with the effect of the link section and the solenoid mechanism, and switches a conveying path of a transfer paper sheet P to either one of the paper-output conveying path 55, the switchback conveying path 53, and the double-face printing conveying path 54.

Moreover, the branch guide 33 is arranged to oscillate and rotate to engage the oscillating gear 61 with the transmission gear 59 or 60.

When the oscillating gear 61 engages the transmission gear 59, to it is transmitted the rotation of the fixing-side delivery gear 5 via the paper-output delivery gear 4, the transmission gear 58, and the transmission gear 59, and the oscillating gear 61 rotates in the clockwise direction.

Meanwhile, when the oscillating gear 61 engages the transmission gear 60, to it is transmitted the rotation of the fixing-side delivery gear 5 via the paper-output delivery gear 4 and the transmission gear 60, and the oscillating gear 61 rotates in the counterclockwise direction.

Then, in the single-face printing for forming an image on a single face of a transfer paper sheet P, the oscillating gear 61 engages the transmission gear 60 with the effect of the link portion after the image formed on the transfer paper sheet is fixed by means of the fixing apparatus 10, and rotates in the counterclockwise direction as described above, while the branch guide 33 guides the transfer paper sheet P to the paper-output conveying path 55. Moreover, the oscillating gear 61 engages the transmission gear 60 to transmit the rotation of the fixing-side delivery gear 5 via the paper-output side delivery gear 4, the transmission gear 60, the oscillating gear 61, the transmission gear 62, and the transmission gear 63 to the transmission gear 35, which thereby rotates in the clockwise direction with the paper-output roller 34.

Thus, at the time of the single-face printing, a transfer paper sheet P which is guided to the paper-output conveying path 55 with the rotation of the paper-output roller 34 in the clockwise direction is output to the paper-output tray 56 from a nip section formed with the paper-output roller 34 and the paper-output roller 57.

Figure 12:
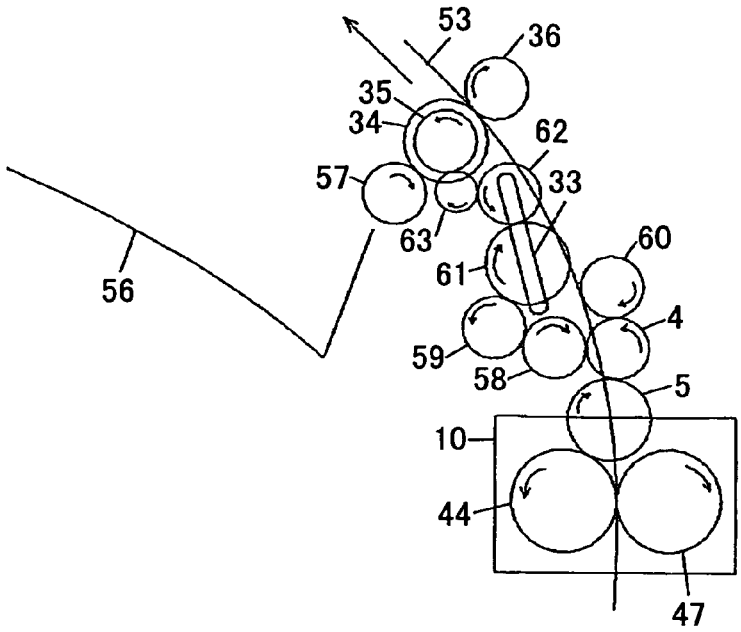
FIG. 12 is a schematic view illustrating a switchback conveying operation in a double-face printing mode of the paper output apparatus.
Figure 13:
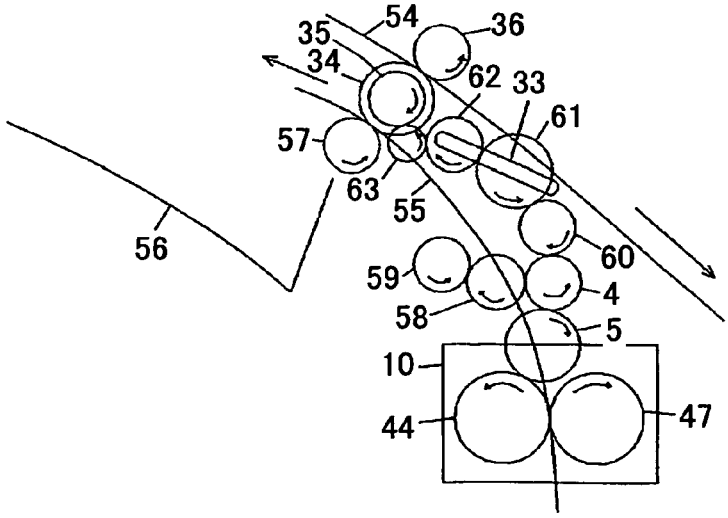
FIG. 13 is a schematic view illustrating a turnover conveying operation in a double-face printing mode of the paper output apparatus.

Next, FIG. 12 shows a switchback conveying operation in the double-face printing, while FIG. 13 shows a turnover conveying operation in the double-face printing. The present embodiment is arranged to repeat the switchback conveying operation as shown in FIG. 12 and the turnover conveying operation as shown in FIG. 13 to perform the double-face printing for printing images on both faces of the transfer paper sheet.

In the double-face printing, after an image formed on one face (a first face) of the transfer paper sheet is fixed by the fixing apparatus 10, as shown in FIG. 12, the oscillating gear 61 engages the transmission gear 59 by the effect of the link portion and solenoid mechanism as described above, and rotates in the clockwise direction, while the branch guide 33 guides the transfer paper sheet to the switchback conveying path 53. Moreover, the oscillating gear 61 engages the transmission gear 59 to transmit the rotation of the fixing-side delivery gear 5 via the paper-output delivery gear 4, the transmission gear 58, the transmission gear 59, the oscillating gear 61, the transmission gear 62, and the transmission gear 63 to the transmission gear 35, which thereby rotates in the counterclockwise direction with the paper-output roller 34.

After the one-face printing in the double-face printing mode, the transfer paper sheet P guided to the switchback conveying path 53 with the rotation of the paper-output roller 34 in the counterclockwise direction is not output to the paper-output tray 56, but is stopped while having its trailing edge nipped by the nip section formed with the paper-output rollers 34 and 36.

In this way, from the position such that the trailing edge of the one-face printed transfer paper sheet P is nipped in the nip section formed with the paper-output rollers 34 and 36, the oscillating gear 61 engages the transmission gear 60 with the effect of the link section as described above, as shown in FIG. 13, and rotates in the counterclockwise direction as described above. Moreover, the oscillating gear 61 engages the transmission gear 60 to transmit the rotation of the fixing-side delivery gear 5 via the paper-output delivery gear 4, the transmission gear 60, the oscillating gear 61, the transmission gear 62, and the transmission gear 63 to the transmission gear 35, which thereby-rotates in the clockwise direction with the paper-output roller 34. Therefore, the paper-output roller 57, which touches the bottom side of the paper-output roller 34, rotates in the counterclockwise direction, while the paper-output roller 36, which touches the top side of the paper-output roller 34, rotates in the clockwise direction. Moreover, with the effect of the link section as described above, the branch guide 33 is arranged to make the branching direction change such that it guides the single-face printed transfer paper sheet P, which has its trailing edge nipped by the nip section formed by the paper-output rollers 34 and 36, to the double-face print conveying path 54, and then the double-face printed transfer paper sheet P is guided to the paper-output conveying path 55.

The one-face printed transfer paper sheet P in double-face printing, which has its trailing edge nipped by the nip section formed by the paper-output rollers 34 and 36, is guided to the double-face print conveying path 54 by the clockwise rotation of the paper-output roller 34, turns over, and is conveyed again to the resist rollers 18 and 19, after which the other face (a second face) is printed with the secondary transfer roller 21 and the follower roller 20. Then, the paper sheet P is fixed at the fixing apparatus 10, after which it is guided to the paper-output conveying path 55 so as to be output to the paper-output tray 56.

In the printer according to the present embodiment, the transmission of the drive power from the fixing apparatus 10 to the paper output apparatus 9 via the multiple gears as described above allows sharing of the drive source between the fixing apparatus 10 and the paper output apparatus 9, thus making possible reduced size and cost of the printer without the need for providing a dedicated drive source for driving such elements as the paper output roller 34.

Moreover, in the configuration as described above, there are two transmission paths for transmitting, to the oscillating gear 61, the drive power of the fixing-side delivery gear 5, which rotates in one direction rather than in one regular direction and the other reverse direction. In other words, the transmission path for rotating the oscillating gear 61 in the counterclockwise direction and eventually rotating the paper-output roller 34 in the clockwise direction includes the paper-output side delivery gear 4 and the transmission gear 60. Moreover, the transmission path for rotating the oscillating gear 61 in the clockwise direction and eventually rotating the paper-output roller 34 in the counterclockwise direction includes the paper-output side delivery gear 4, the transmission gear 58, and the transmission gear 59. In this way, the configuration as described above, for eventually making the rotational direction of the paper-output roller 34 counterclockwise, can be arranged more easily relative to that for making the rotational direction of the paper-output roller clockwise by providing one more gear between the paper-output delivery gear 4 and the oscillating gear 61. Therefore, merely oscillating the branch guide 33 to switch among the transmission paths for transmitting the drive power from the paper-output delivery gear 4 to the oscillating gear 61 allows simply switching the rotational direction of the paper-output roller 34 to the one regular and the other reverse directions.

Example 1

Figure 1:
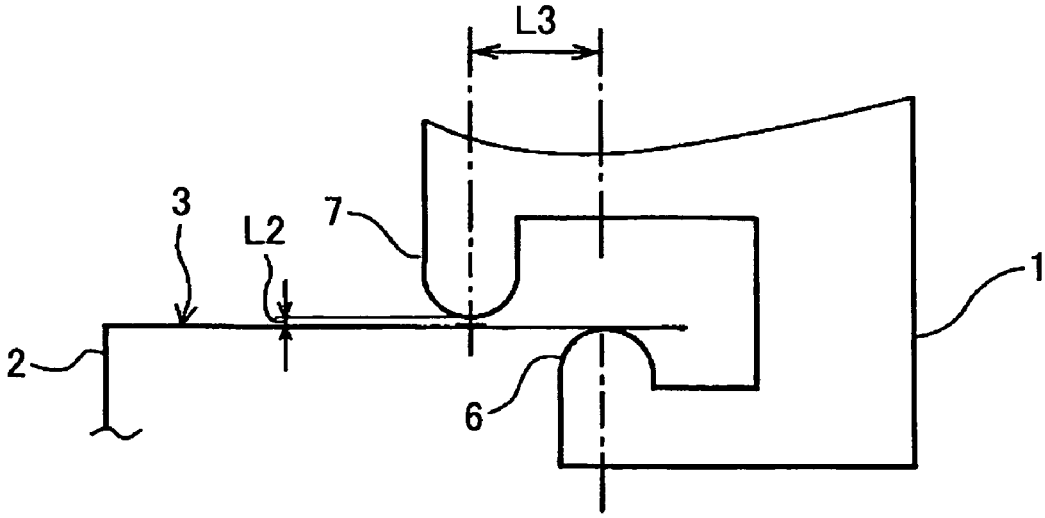
FIG. 1 is a schematic diagram illustrating elements of a paper-output apparatus according to Example 1.
Figure 14:
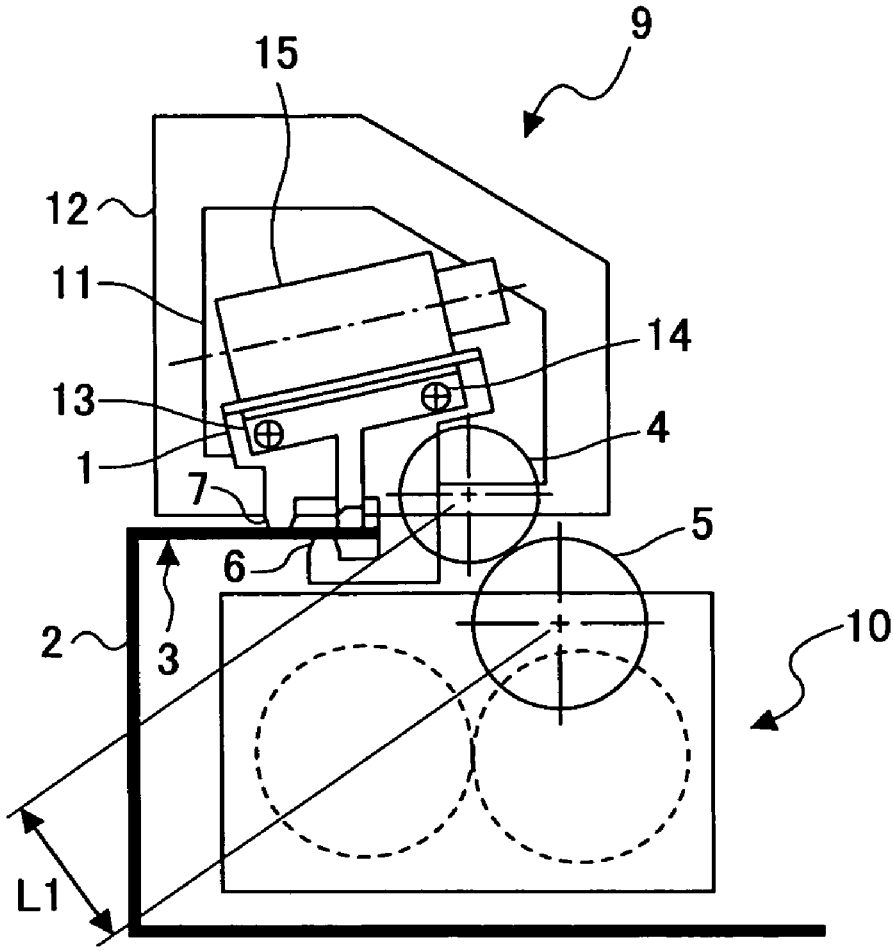
FIG. 14 is a perspective view of the device body, illustrating the paper output apparatus and fixing apparatus positioned relative to and assembled to the device body in Example 1.

In the present example, as shown in FIG. 1, the solenoid fixing member 1 has a protruding shape 6, which is arranged to touch the bottom face of a top-face section 3 of the body frame 2 when assembling the paper output apparatus 9 to the body frame 2. In this way, arranging for the protruding shape 6 to touch the bottom face of the top-face section 3 of the body frame 2 makes it possible to position the gear housing 11 relative to the device body such that the position of the paper-output side delivery gear 4 of the gearing housing 11 on which the solenoid fixing member 1 is mounted is made proper relative to the fixing-side delivery gear 5 of the fixing apparatus 10 that is positioned to the device body. In other words, when the paper-output apparatus 9 is assembled to the device body, the protruding shape 6 serves as a stopper for ensuring that the difference between an intercentral distance L1 between the fixing-side delivery gear 5 and the paper-output side delivery gear 4, as shown in FIG. 14, and a median value (a predetermined value) does not increase.

Here, the median value (the predetermined value) for the intercentral distance L1 is an intercentral distance between the fixing-side delivery gear 5 and the paper-output side delivery gear 4 when the gears are engaged with each other such that the drive power is smoothly transmitted from the fixing-side delivery gear 5 to the paper-output side delivery gear 4.

As described above, arranging for the protruding shape 6 to touch the bottom face of the top face section 3 of the body frame 2 when assembling the paper-output apparatus 9 to the body frame 2 makes it possible to eliminate the effect of the assembly tolerance related to assembling the gear housing 11 to the output paper guide 12, which is a side wall of the paper-output apparatus 9, on the tolerance in the direction of the gap between the paper-output side delivery gear 4 and the fixing-side delivery gear 5. Thus, the decrease in the tolerance in the gap direction by the above-described eliminated amount makes it easier for the paper-output side delivery gear 4 and the fixing-side delivery gear 5 to properly engage. Therefore, it is made easier to smoothly transmit the drive power between the paper-output side delivery gear 4 and the fixing-side delivery gear 5.

Moreover, the solenoid-fixing member 1 has a protruding member 7, as shown in FIG. 1. This protruding member 7 serves as a stopper for preventing the intercentral distance L1 between the neighboring paper-output side delivery gear 4 and the fixing-side delivery gear 5 from becoming smaller than the median value while having a gap L2 relative to the top face of the top-face section 3 of the body frame 2. The gap L2 is set at a minimum within in a range such that the top-face section 3 can be inserted between the protruding shape 6 and the protruding shape 7.

Moreover, as shown in FIG. 1, the protruding shape 6 and the protruding shape 7 are provided, opposite the top-face section 3, on the solenoid-fixing member 1 at non-opposing positions at a separation distance L3. In this way, providing the protruding shape 6 and the protruding shape 7 on the solenoid-fixing member 1 at non-opposing positions makes it possible to smoothly insert the top-face section 3 of the body frame 2 between the protruding shape 6 and the protruding section 7 when assembling, to the device body, the paper-output apparatus 9, which includes the gear housing 11 at which the solenoid-fixing member 1 is provided.

Now, as described above, the solenoid-fixing member 1, which has the protruding shape 6 and the protruding shape 7, is arranged to be integrally structured with the output-paper guide 12 via the gear housing 11, also serves to position the output paper guide 12 relative to the body frame 2. Thus, when the paper-output apparatus 9 is assembled to the device body, it is possible to maintain both the intercentral distance L1 as well as the precision of position relative to the printer body of the output paper guide 12.

Figure 15:
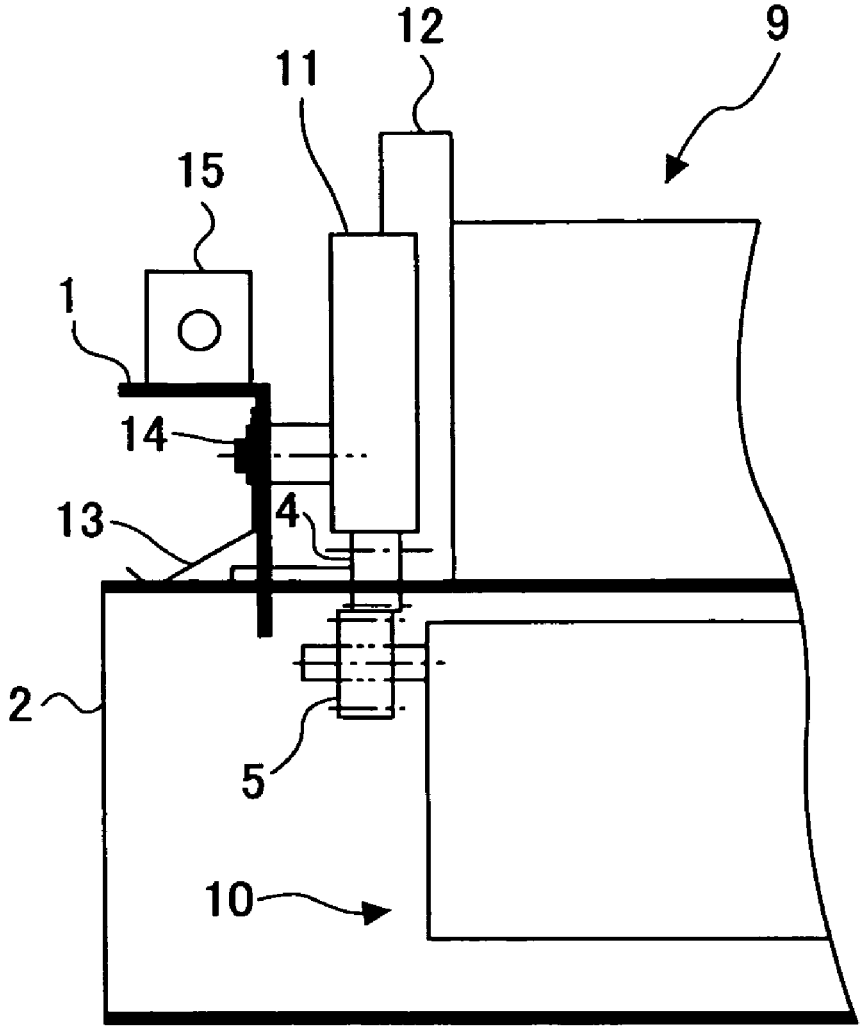
FIG. 15 is a front view of the device body, illustrating the paper output apparatus and fixing apparatus positioned relative to and assembled to the device body in Example 1.

Next, a metal plate spring 13 provided on the solenoid-fixing member 1 is described. As shown in FIGS. 14 and 15, the plate spring 13 is tightly attached to the solenoid-fixing member 1 with screws 14, which fixes the solenoid-fixing member 1 to the gear housing 11. The tip of the plate spring 13 always touches the top face of the top-face section 3, and generates a spring force required to make the protruding shape 6 always touch the bottom face of the top-face section 3. In the present example, the bottom face of the top-face section 3 is arranged to be energized by the plate spring 13 in the direction towards the protruding shape 6, but the plate spring 13 may be mounted such that the protruding shape 6 is energized in the direction towards the bottom face of the top-face section 3. Moreover, the plate spring 13 also serves as a ground line for electrical conduction of the body frame 2, which has electrical conduction to the ground such that the solenoid 15 and solenoid-fixing member 1, which are metal parts, are electrically grounded.

Example 2

Figure 16:
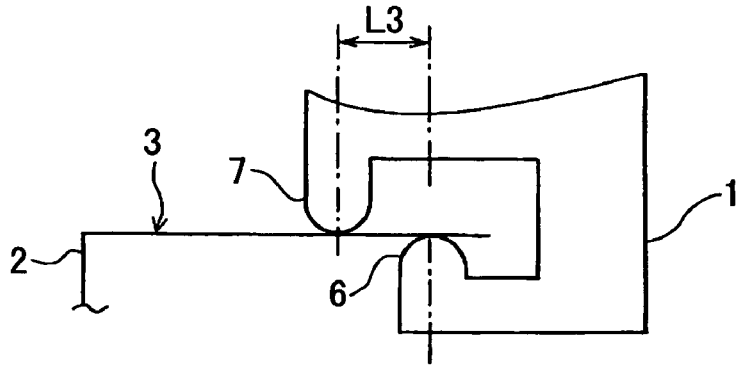
FIG. 16 is a schematic diagram illustrating elements of a paper output apparatus according to Example 2.

In the present example, the configuration is basically the same as that of the Example 1, except that, as shown in FIG. 16, the distance of the gap between the protruding shape 6 and the protruding shape 7, which are formed at the solenoid-fixing member 1 is arranged to be a minimum distance within a range such that the top-face section 3 of the body frame 2 can be inserted into the gap, and the protruding shapes 7 and 6 touch the top and bottom faces of the top-face section 3 of the body frame 2, respectively. In this way, a positive or negative difference between the intercentral distance L1 between the fixing-side delivery gear 5, which the fixing apparatus 10, positioned relative to and assembled to the device body, has, and the paper-output delivery gear 4 of the gear housing 11 to which the solenoid-fixing member 1 is mounted, is suppressed in a more ensured manner.

Embodiment 2

The basic configuration of the image forming device according to the present embodiment is substantially the same as that of the printer, which is the image forming device according to the Embodiment 1, so that the explanation thereof is omitted.

Example 3

Figure 17:
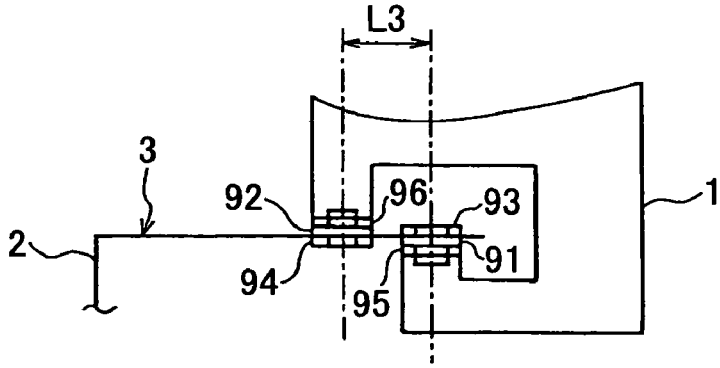
FIG. 17 is a schematic diagram illustrating elements of a paper output apparatus according to Example 3.

In the present example, as shown in FIG. 17, the solenoid-fixing member 1 is fixed to the top-face section 3 of the body frame 2 with screws 93, 94, and nuts 95, 96. More particularly, screw holes (not shown) are provided in engaging sections 91 and 92 of the solenoid-fixing member 1, which is provided at a paper-output driver 32. The solenoid-fixing member 1 and the top-face section 3 are fitted to screw holes (not shown) of engaged sections provided at the top-face section 3 of the body frame 2 such that they are nipped by the screws 93, 94 and nuts 95, 96, which are respectively engaging members.

As described above, fixing the solenoid-fixing member 1 to the top-face section 3 of the body frame 2 makes it possible to eliminate the effect of the assembly tolerance related to the assembling of the gear housing 1 to the output-paper guide 12, which is a side wall of the paper-output apparatus 9, on the tolerance in the direction of the gap between the paper-output side delivery gear 4 and the fixing-side delivery gear 5. Thus, the tolerance in the above-described gap direction is reduced by the eliminated tolerance amount.

Figure 18:
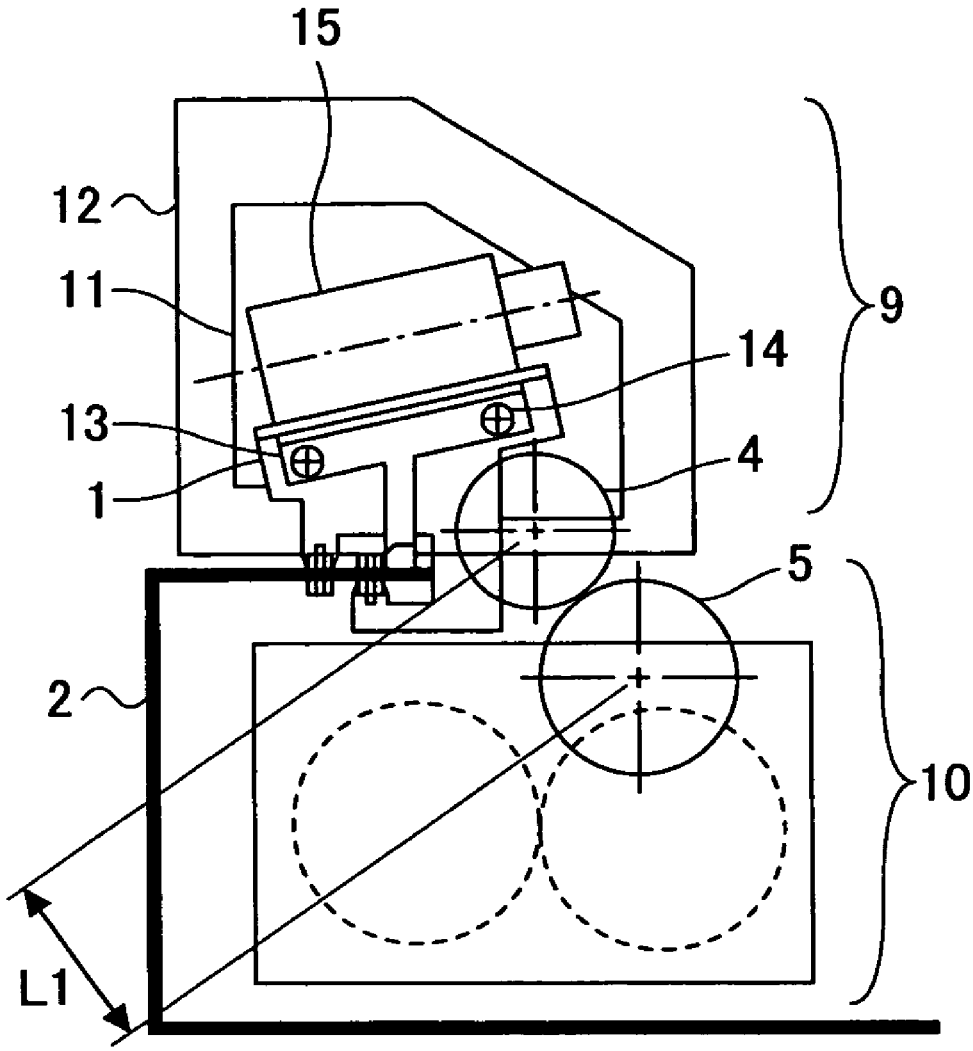
FIG. 18 is a perspective view of the device body, illustrating the paper output apparatus and fixing apparatus positioned relative to and assembled to the device body in Example 3.

In this way, the paper-output apparatus 9 can be assembled to the body frame 2 such that the intercentral distance L1, as shown in FIG. 18, between the paper-output side delivery gear 4, which is provided at the gear housing 11 of the paper-output apparatus 9 and the fixing-side delivery gear 5, which is provided at the fixing apparatus 10, easily achieves a median value (a predetermined distance). Thus, the tolerance of assembling the paper-output apparatus 9 and the fixing apparatus 10 to the device body causing a positive or negative difference between the intercentral distance L1 and the median value (the predetermined distance) can be reduced.

Moreover, engaging the gear housing 11 to the top-face section 3 of the body frame 2 with the screws 93, 94, and the nuts 95, 96 makes it possible to reduce oscillations, etc., causing the gear housing 11 to be displaced and the intercentral distance L1 to change.

Moreover, as shown in FIG. 17, the engaging sections 91 and 92 are provided at a separation distance L3 at non-opposing positions across the top-face section 3 at the solenoid-fixing member 1. In this way, providing the engaging section 91 and the engaging section 92 at non-opposing positions at the solenoid-fixing member 1 makes it possible to smoothly insert the top-face section 3 of the body frame 2 between the engaging section 91 and the engaging section 92 when assembling, to the device body, the paper-output apparatus 9, which includes the gear housing 11, at which the solenoid-fixing member 1 is provided.

Now, as described above, the solenoid fixing member 1, which has the protruding shape 6 and the protruding shape 7, is arranged to be integrally structured with the output-paper guide 12 via the gear housing 11, so that it also serves to position the output-paper guide 12 relative to the body frame 2. Therefore, when the paper-output apparatus 9 is assembled to the device body, it is possible to maintain not only the intercentral distance L1, but also the precision of positioning the output-paper guide 12 relative to the printer body.

As described above, according to the present embodiments, the image forming device includes the process unit 26, which is a toner-image forming unit for forming a toner image; the transfer unit 75, which is a transfer unit for transferring, onto a transfer material, the toner image formed by the process unit 26; a fixing apparatus 10, which is a fixing unit for fixing, onto a transfer material, by a pair of fixing rollers including a fixing roller 44 and a pressurizing roller 47, the toner image transferred by the transfer unit 75; a paper-output apparatus 9, which is a paper-output unit for outputting a transfer material onto which the toner image is fixed by the fixing apparatus 10 out of the device by a pair of paper-output rollers including a paper-output roller 34 and a paper-output roller 57; a drive source which is a driving unit for driving a pair of fixing rollers or paper-output rollers; a fixing-side delivery gear 5, which is a first drive-power transmission gear provided at the fixing apparatus 10, for transmitting, from the fixing-apparatus side to the paper-output apparatus side, drive power by the drive source, or receiving drive power transmitted from the paper-output apparatus side to the fixing-apparatus side; a paper-output side delivery gear 4, which engages the fixing-side delivery gear 5, for having drive power transmitted from the fixing-side delivery gear 5 or transmitting drive power to the fixing-side delivery gear 5; a gear housing 11, which is mounted on an output paper guide 12, which is a side wall of the paper-output apparatus 9, located in the axial direction of the paper-output roller, which gear housing 11 rotatably supports transmission gears which include the paper-output side transmission gear 4, and multiple drive-power transmission gears for transmitting drive power between the paper-output side transmission gear 4 and the pair of paper-output rollers; a first positioning unit which positions the fixing apparatus 10 relative to the body frame 2 of the device body; and a second positioning unit which positions the paper-output apparatus 9 relative to the body frame 2 of the device body, the second positioning unit engaging the gear housing 11 with the body frame 2 to position the paper-output apparatus 9 relative to the body frame 2 in the direction of the gap between the fixing-side delivery gear 5 and the paper-output side delivery gear 4. In this way, the effect of tolerance caused by mounting the gear housing 11 on the paper-output guide 12, which is a side wall of the paper-output apparatus 9 on the tolerance in the direction of the gap between the paper-output side delivery gear 4 and the fixing-side delivery gear 5 can be eliminated. Thus, the decrease in the tolerance in the gap direction by the above-described eliminated tolerance makes it easier for the paper-output side delivery gear 4 and the fixing-side delivery gear 5 to properly engage. Therefore, it is made easier to smoothly transmit the drive power between the paper-output side delivery gear 4 and the fixing-side delivery gear 5. Therefore, it is possible to make it easier to properly transmit the drive power from the fixing apparatus 10 to the paper-output apparatus 9 via the fixing-side delivery gear 5 and the paper-output side delivery gear 4.

Moreover, according to Embodiment 1, the second positioning unit positions the gear housing 11 relative to the device body by arranging for the top-face section 3, which is a positioning section provided at the body frame 2, which is a side wall of the apparatus main frame, to touch the solenoid-fixing member 1, which is a positioning member provided at the gear housing 11. In this way, allowing the positioning of the gear housing 11 by arranging for the solenoid-fixing member 1 to touch the top-face section 3 makes it possible to reduce the requirement for high dimensional precision with respect to the solenoid-fixing member 1 and the body frame 2, etc.

Moreover, according to Embodiment 2, the second positioning unit positions the gear housing 11 relative to the device body by arranging for the top-face section 3, which is a positioning section provided at the body frame 2, which is a side wall of the device body, to touch the solenoid-fixing member 1, which is a positioning member provided at the gear housing 11. In this way, the oscillations, etc. causing the gear housing 11 to be displaced and the intercentral distance L1 to change can be suppressed.

According to Embodiment 1, the solenoid-fixing member 1 has the protruding shape 6, which touches the bottom face, which is the fixing apparatus side face of the top-face section 3 of the device body 2, which is a side wall of the device body that is provided between the paper-output apparatus 9 and the fixing apparatus 10. The paper-output apparatus 9 is mounted in the device body while arranging for the protruding shape 6 to touch the bottom face of the top-face section 3, which makes it possible to prevent the intercentral distance L1 from becoming larger than the predetermined distance as described above.

According to Embodiment 1, the solenoid-fixing member 1 has the protruding shape 7, which is a second protruding shape provided such that it touches the top face, which is the paper-output apparatus side face of the top-face section 3 of the device body 2, which is a side wall of the device body that is provided between the paper-output apparatus 9 and the fixing apparatus 10, or such that it is located at a distance L2. Such protruding shape 7 makes it possible to prevent the intercentral distance L1 from becoming smaller than the predetermined distance as described above.

According to Embodiment 1, providing the protruding shapes 6 and 7 at non-opposing positions across the top-face section 3 of the body frame 2 makes it possible to smoothly insert the top-face section 3 of the body frame 2 between the protruding shapes 6 and 7 when mounting the paper-output apparatus 9 in the device body.

Moreover, according to Example 2 of Embodiment 1, the distance between the protruding shape 6 and the protruding shape 7 in the vertical direction is arranged to be a minimum distance within a range such that the top-face section 3 of the body frame 2 can be inserted in the gap formed between the protruding shape 6 and the protruding shape 7. In this way, the difference of the intercentral distance L1 from the predetermined distance can be reduced.

According to Embodiment 1, the plate spring 13 is provided, which is an energizing unit for energizing the protruding shape 6 in the direction toward the bottom face of the top-face section 3, or energizing the bottom face of the top-face section 3 in the direction toward the protruding shape 6. In this way, the protruding shape 6 can be arranged to always touch the bottom face of the top-face section 3.

According to Embodiments, the solenoid 15 is provided, which changes the gear arrangement of the gear housing 11. Arranging for the positioning member as described above to be the solenoid-fixing member 1, which is a sheet-metal member for fixing the solenoid 15 to the gear housing 11, makes it possible to position the gear housing 11 in a simple configuration.

According to Embodiment 1, the energizing unit as described above, which is the plate spring 13, which is conductive, the plate spring 13 touching the solenoid-fixing member 1 and the body frame 2, can also be used as a ground line to the body frame 2 for the solenoid 15 and the solenoid-fixing member 1, as described above.

According to the Embodiments, the paper-output apparatus 9 has the output-paper guide 12, which is a guide member for guiding, to a pair of paper-output rollers, transfer material fed from the fixing member 10, and the gear housing 11 is fixed to the output-paper guide 12. In this way, the gear housing 11, to which the solenoid-fixing member 1 for positioning the gear housing 11 is mounted is integrally structured with the output-paper guide 12, also making it possible to position the output-paper guide 12 relative to the body frame 2.

The present application is based on the Japanese Priority Application No. 2007-276881 filed on Oct. 24, 2007, the entire contents of which are hereby incorporated by reference.

The invention claimed is:

1. An image forming device, comprising:

a toner-image forming unit which forms a toner image;

a transfer unit which transfers, to a transfer material, the toner image formed by the toner-image forming unit;

a fixing unit which fixes, to the transfer material by a pair of fixing rollers, the toner image transferred by the transfer unit;

a paper-output unit which outputs, out of the device by a pair of paper-output rollers, the transfer material to which the toner image is fixed by the fixing unit;

a drive unit which drives the pair of fixing rollers or the pair of paper-output rollers;

a first drive-power transmission gear, provided at the fixing unit, for transmitting from a fixing-unit side to a paper-output unit side a drive power by the drive unit, or receiving a drive power transmitted from the paper-output unit side to the fixing-unit side;

a second drive-power transmission gear, engaged with the first drive-power transmission gear, for having a drive power transmitted from the first drive-power transmission gear or transmitting a drive power to the first drive-power transmission gear;

a gear housing, mounted on a side wall of the paper-output unit in an axial direction of the paper-output rollers, for rotatably supporting the second drive-power transmission gear, and multiple drive-power transmission gears which transmit a drive power between the second drive-power transmission gear and the paper-output rollers;

a first positioning unit which positions the fixing unit relative to a device body; and a second positioning unit which positions the paper-output unit relative to the device body, wherein:

the second positioning unit positions the paper-output unit relative to the device body in the direction of a gap between the first drive-power transmission gear and the second drive-power transmission gear by engaging the gear housing with the device body, the second positioning unit positions the gear housing relative to the device body by having a positioning section provided at the device body side wall touching a positioning member provided at the gear housing, the positioning member has a protruding shape which touches a face on a fixing-unit side of a device body side wall provided between the paper-output unit and the fixing unit, the positioning member has a second protruding shape which is provided such that the second protruding shape touches a face on the paper-output unit side of the device body side wall provided between the paper-output unit and the fixing unit, or which is provided at a predetermined distance, the protruding shape and the second protruding shape are provided at the positioning member at non-opposing positions across the device body side wall provided between the paper-output unit and the fixing-unit, and a distance in a vertical direction between the protruding shape and the second protruding shape is arranged to be a minimum distance within a range such that the device body side wall provided between the paper-output unit and the fixing unit can be inserted into a gap formed between the protruding shape and the second protruding shape.

2. The image forming device as claimed in claim 1, wherein the second positioning unit positions the gear housing relative to the device body by engaging, by an engaging member, a positioning section provided at the device body side wall with a positioning member provided at the gear housing.

3. The image forming device as claimed in claim 1, comprising:

an energizing unit which energizes the protruding shape in a direction toward the face on the fixing-unit side, or energizes the face on the fixing-unit side in a direction toward the protruding shape.

4. The image forming device as claimed in claim 3, comprising:

a solenoid which changes a gear arrangement of the gear housing, wherein the positioning member is a sheet-metal member which fixes the solenoid at a drive-power transmission section.

5. The image forming device as claimed in claim 4, wherein the energizing unit is a conductive plate spring which touches the sheet-metal member and the device body side wall.

6. The image forming device as claimed in claim 2, comprising:

a solenoid which changes a gear arrangement of the gear housing, wherein the positioning member is a sheet-metal member which fixes the solenoid to a drive-power transmission section.

7. The image forming device as claimed in claim 6, wherein the paper-output unit has a guide member which guides the transfer material fed from the fixing unit to the pair of paper-output rollers, wherein the gear housing is fixed to the guide member.

8. An image forming device, comprising:

a toner-image forming unit which forms a toner image;

a transfer unit which transfers, to a transfer material, the toner image formed by the toner-image forming unit;

a fixing unit which fixes, to the transfer material by a pair of fixing rollers, the toner image transferred by the transfer unit;

a paper-output unit which outputs, out of the device by a pair of paper-output rollers, the transfer material to which the toner image is fixed by the fixing unit;

a drive unit which drives the pair of fixing rollers or the pair of paper-output rollers;

a first drive-power transmission gear, provided at the fixing unit, for transmitting from a fixing-unit side to a paper-output unit side a drive power by the drive unit, or receiving a drive power transmitted from the paper-output unit side to the fixing-unit side;

a second drive-power transmission gear, engaged with the first drive-power transmission gear, for having a drive power transmitted from the first drive-power transmission gear or transmitting a drive power to the first drive-power transmission gear;

a gear housing, mounted on a side wall of the paper-output unit in an axial direction of the paper-output rollers, for rotatably supporting the second drive-power transmission gear, and multiple drive-power transmission gears which transmit a drive power between the second drive-power transmission gear and the paper-output rollers;

a first positioning unit which positions the fixing unit relative to a device body; and a second positioning unit which positions the paper-output unit relative to the device body, wherein:

the second positioning unit positions the paper-output unit relative to the device body in the direction of a gap between the first drive-power transmission gear and the second drive-power transmission gear by engaging the gear housing with the device body, the second positioning unit positions the gear housing relative to the device body by engaging, by an engaging member, a positioning section provided at the device body side wall with a positioning member provided at the gear housing, and a solenoid which changes a gear arrangement of the gear housing, wherein the positioning member is a sheet-metal member which fixes the solenoid to a drive-power transmission section.

* * * * *